US006220345B1

(12) United States Patent
Jones et al.

(10) Patent No.: US 6,220,345 B1
(45) Date of Patent: Apr. 24, 2001

(54) WELL SCREEN HAVING AN INTERNAL ALTERNATE FLOWPATH

(75) Inventors: Lloyd G. Jones, Dallas; Raymond J. Tibbles, Missouri City, both of TX (US); Gary D. Hurst, Comanche, OK (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/377,674

(22) Filed: Aug. 19, 1999

(51) Int. Cl.[7] ..... E21B 43/04

(52) U.S. Cl. ..... 166/51; 166/233; 166/236; 166/278

(58) Field of Search ..... 166/227, 231, 166/233, 236, 51, 278

(56) References Cited

U.S. PATENT DOCUMENTS 4,945,991 8/1990 Jones .
5,107,927 * 4/1992 Whiteley et al. .
5,113,935 5/1992 Jones et al. .
5,333,688 8/1994 Jones et al. .
5,341,880 8/1994 Thorstenson et al. .
5,355,949 10/1994 Sparlin et al. .
5,413,180 * 5/1995 Ross et al. .
5,419,394 5/1995 Jones .
5,476,143 12/1995 Sparlin et al. .
5,515,915 5/1996 Jones et al. .

* cited by examiner

*Primary Examiner*—Roger Schoeppel

(57) ABSTRACT

A well screen having an internal, blank alternate flowpath for delivering fracturing fluid/gravel slurry to different levels within a well annulus. The well screen includes an outer pipe which is positioned over a base pipe thereby forming an annulus therebetween. The circumference of each pipe has a perforated sector and a blank sector, both of which extend along their respective lengths. When assembled, the respective perforated sectors are aligned to form a perforated, production sector and the respective blank sectors are aligned to form the blank, alternate flowpath. The base pipe is wrapped with wire to prevent solids from flowing through the openings therein. Slurry is pumped into the annulus where it flows circumferently from the blank, alternate flowpath to exit into the well annulus through the openings in the perforated sector of the annulus.

9 Claims, 2 Drawing Sheets

WELL SCREEN HAVING AN INTERNAL ALTERNATE FLOWPATH

DESCRIPTION

1. Technical Field

The present invention relates to a well screen and in one of its aspects relates to a well screen for fracturing/gravel packing a well having an internal, alternate flowpath which, in turn, is formed between the aligned, blank sectors of two pipes.

2. Background of the Invention

In producing hydrocarbons or the like from certain subterranean formations, it is common to produce large volumes of particulate material (e.g. sand) along with the formation fluids, especially when the formation has been fractured to improve flow therefrom. This sand production must be controlled or it can seriously affect the economic life of the well. One of the most commonly-used techniques for controlling sand production is known as "gravel packing". In a typical gravel pack completion, a screen is positioned within the wellbore adjacent the interval to be completed and a gravel slurry is pumped down the well and into the well annulus around the screen. As liquid is lost from the slurry into the formation and/or through the screen, gravel is deposited within the well annulus to form a permeable mass around the screen. This gravel (e.g. sand) is sized to allow the produced fluids to flow therethrough while blocking the flow of most particulate material into the screen.

A major problem in fracturing/gravel packing a well-especially where long or inclined intervals are to be completed lies in adequately distributing the fracturing fluid/gravel slurry (hereinafter referred to as "gravel slurry") over the entire completion interval. That is, in order to insure an adequate "frac-pac" of a long completion and/or inclined interval, it is necessary for the gravel slurry to reach all levels within that interval. Poor distribution of the gravel slurry throughout the interval (i.e. along the entire length of the screen) typically results in (a) only a partial fracturing of the formation and (b) a gravel pack having substantial voids therein.

Poor distribution of the gravel slurry is often caused when carrier fluid from the slurry is lost prematurely into the more permeable portions of the formation and/or into the screen, itself, thereby causing "sand bridge(s)" to form in the well annulus around the screen before the formation has been adequately fractured and all of the gravel has been placed. These sand bridges effectively block further flow of the gravel slurry through the well annulus thereby preventing delivery of gravel to all levels within the completion interval.

To alleviate this problem, "alternate-path" well tools (e.g. well screens) have been proposed and are now in use which provide for the good distribution of gravel throughout the entire completion interval even when sand bridges form before all of the gravel has been placed. Such tools typically include perforated shunts or by-pass conduits which extend along the length of the tool and which are adapted to receive the gravel slurry as it enters the well annulus around the tool. If a sand bridge forms before the operation is complete, the gravel slurry can still be delivered through the perforated shunt tubes (i.e. "alternate-paths") to the different levels within the annulus, both above and/or below the bridge. For a more complete description of a typical alternate-path well screen and how it operates, see U.S. Pat. No. 4,945,991, which is incorporated herein by reference.

In many prior-art, alternate-path well screens of the type described above, the individual shunts tubes are carried externally on the outer surface of the screen; see U.S. Pat. No. 4,945,991; 5,082,052; 5,113,935; 5,417,284; and 5,419,394. While this arrangement has proven highly successful, externally-mounted shunts do have some disadvantages. For example, by mounting the shunts externally on the screen, the effective, overall outside-diameter of the screen is increased. This can be very important especially when a screen is to be run into a relatively small-diameter wellbore where even fractions of an inch in its outer diameter may make the screen unusable or at least difficult to install in the well.

Another disadvantage in mounting the shunts externally lies in the fact that the shunts are exposed to damage during assembly and installation of the screen. If the shunt is crimped or otherwise damaged during installation, it can become totally ineffective in delivering the gravel to all of the levels in the completion interval which, in turn, may result in the incomplete fracturing/packing of the interval. Several techniques have been proposed for protecting these shunts by placing them inside the screen; see U.S. Pat. Nos. 5,341,880, 5,476,143, and 5,515,915. However, this can make the construction of such screens more sophisticated, if not more complicated, which, in turn, normally results in substantially higher production costs.

Recently, another alternate-path screen is disclosed and claimed in co-pending and commonly assigned, US patent application Ser. No. 09/290,605, filed Apr. 13, 1999 which simplifies the construction of a screen having an internal alternate flowpath. The screen disclosed therein is comprised of two concentric pipes, i.e. an inner base pipe and an outer pipe. A portion of the annulus which is formed between the two concentric pipes provides the alternate flowpath(s) for conveying gravel slurry to different levels within the completion interval.

Dividers (e.g. ribs) extend longitudinally within the annulus between the pipes to separate the alternate flowpath portion of the annulus from a perforated, production portion of the annulus. The outer surface of the outer pipe is wrapped with wire or the like to prevent sand from flowing into the production portion of the annulus. Openings are longitudinally-spaced along the outer pipe to provide outlets for the alternate flowpath whereby gravel slurry can be delivered from the alternate flowpath to different levels within the completion interval.

SUMMARY OF THE INVENTION

The present invention provides still another well screen which has an internal, alternate flowpath for delivering fracturing fluid/gravel slurry to different levels within a well annulus during a fracturing/gravel pack or "frac-pac" operation. The delivery of gravel directly to several different levels within the well annulus provides a much better distribution of the gravel throughout the completion interval especially when sand bridges form in the annulus before all of the gravel has been placed. By placing the alternate flowpath inside the screen, it is protected from damage and abuse during the handling and installation of the screen and does not increase the effective diameter of the screen.

More specifically, the well screen of the present invention is comprised of a larger-diameter, outer pipe which is positioned over a base pipe whereby an annulus (e.g. preferably less than about one inch in width) is formed between the two pipes. Preferably, the pipes are substantially concentric but in some instances they may be positioned slightly off-center wherein the annulus is slightly larger on one side than the other. The circumference of each pipe has a perforated sector (i.e. sector having openings therein) which subtends a central angle of "α" and a blank sector (i.e. sector which is devoid of openings) which extend along the lengths of the respective pipes. When the well screen is assembled and the base pipe is positioned within the outer pipe, the respective perforated sectors are radially aligned to form a perforated, production sector within the annulus between the pipes and the respective blank sectors are radially aligned to form a blank, alternate flowpath sector within the annulus.

The base pipe is wrapped with wire to allow the flow of fluids through the openings in the base pipe while blocking the flow of solids therethrough. An inlet is provided through the upper end of the annulus to allow gravel slurry to flow into the annulus between the pipes. The slurry flows into the blank, alternate flowpath sector of the annulus but, since there are no openings in this sector, the slurry can not exit directly into the well annulus. Accordingly, the slurry must first flow downward into the blank sector and then circumferentally into the perforated sector of the annulus from which, it can then exit into the well annulus to fracture the formation and/or to form the gravel pack.

As the slurry flows into the perforated sector, either directly or from the blank sector, carrier fluid begins to leak-off from the slurry into the formation and/or through the openings in the base pipe thereby causing the perforated sector to begin to fill with sand from the slurry. When this occurs, a "sand bridge" will have likely already been formed in the well annulus which, in the absence of an alternate flowpath, would block further flow of slurry through the well annulus and would likely result in an unsuccessful completion.

As the sand pack in the perforated sector of the present screen begins to build back into the blank, alternate flowpath sector of the annulus, the high viscosity (e.g. not less than about 20 centipoises) of the carrier fluid of the slurry greatly retards further circumferential leak-off through the built-up sand pack within the annulus. The continued pumping of the slurry will now force the slurry downward through the blank, alternate flowpath sector of the annulus to a different level within the annulus where no sand pack has yet formed. The alternate flowpath sector is kept open by the slow circumferential growth of the sand pack within the annulus and by the relatively high fluid velocity in the remaining open sector of the annulus.

Once the completion interval has been fractured and/or gravel packed and the well has been put on production, the produced fluids can now flow through the newly-placed gravel pack, through the production, perforated sector of the screen and into the base pipe to be produced to the surface. By being able to deliver fracturing fluid/gravel slurry directly to different levels within the completion interval through the blank, alternate flowpath of the present screen, there will be a better distribution of gravel throughout the entire completion interval, especially when sand bridges form in the well annulus before all of the gravel has been placed. Also, since the alternate flowpath is internally formed between the two pipes, the present screen is relatively simple in construction and relatively inexpensive to build and the flowpath is protected from damage and abuse during handling and installation of the screen.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
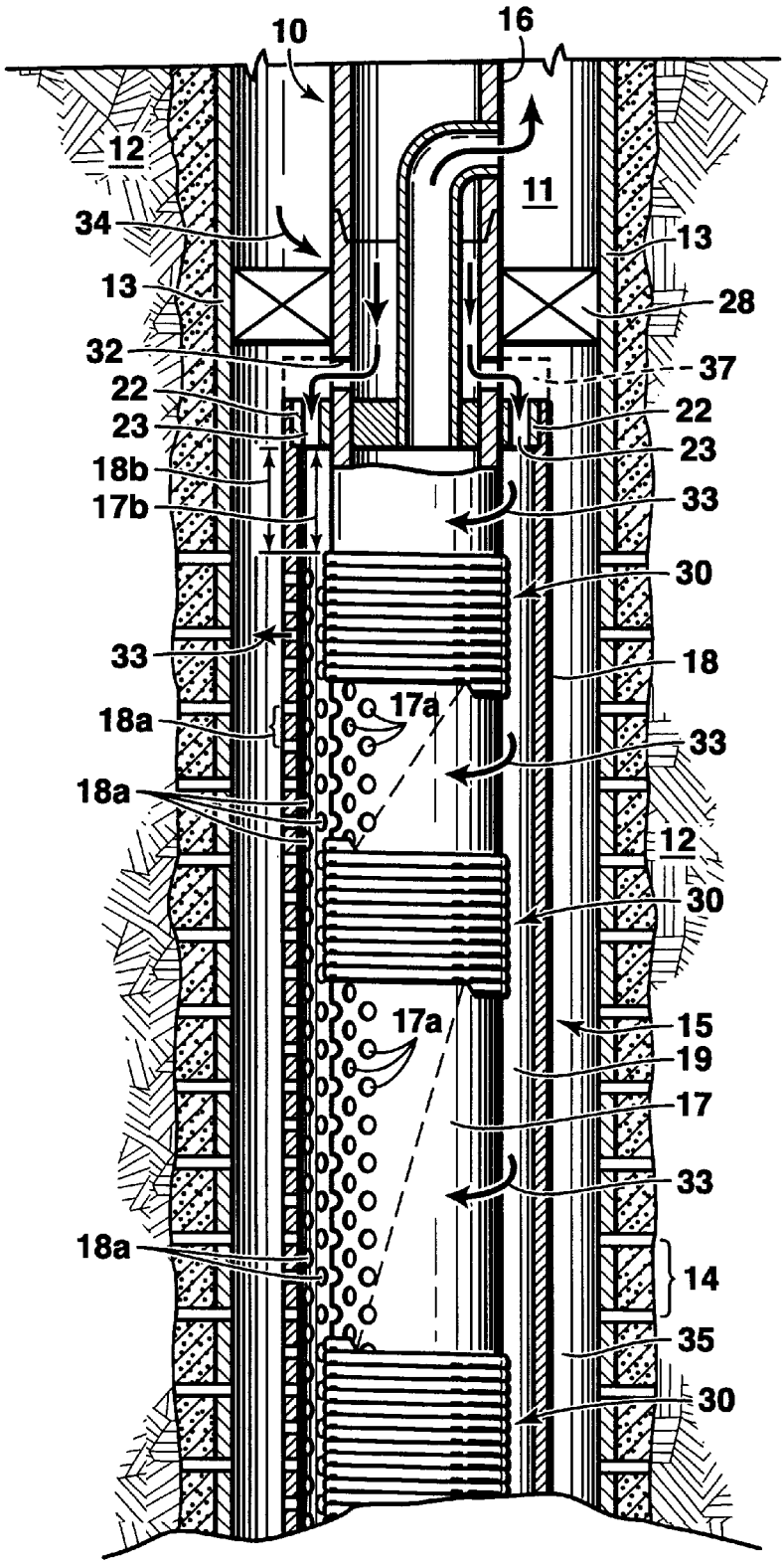
FIG. 1 is an elevational view, partly in section and cutaway, of a well tool in accordance with the present invention in an operable position within a well.

Referring more particularly to the drawings, FIG. 1 illustrates the present well tool 10 in an operable position within the lower end of a producing and/or injection wellbore 11. Wellbore 11 extends from the surface (not shown) and into or through formation 12. Wellbore 11, as shown, is cased with casing 13 having perforations 14 therethrough, as will be understood in the art. While wellbore 11 is illustrated as being a substantially vertical, cased well, it should be recognized that the present invention can be used equally as well in "open-hole" and/or underreamed completions as well as in horizontal and/or inclined wellbores. Well tool 10 (e.g. gravel pack screen) may be of a single length or it may be comprised of several joints (only the portion of the upper joint is shown) which are connected together with threaded couplings and/or blanks or the like as will be understood in the art.

As shown, a typical joint 15 of gravel pack screen 10 is comprised of a base pipe 17 which is positioned within a larger-diameter, outer pipe or shroud 18. Preferably, the two pipes are concentrically positioned with respect to each other but in some instances the base pipe may be slightly off-center with respect to the outer pipe. When assembled for operation, base pipe 17 will be fluidly connected to the lower end of a workstring 16 which, in turn, extends to the surface (not shown). The respective diameters of base pipe 17 and outer pipe 18 are sized to provide an annulus 19 therebetween, the width of which is preferably small; e.g. less than about one inch and even more preferably from about ⅛ inch to about ¼ inch for most typical completions.

Figure 3:
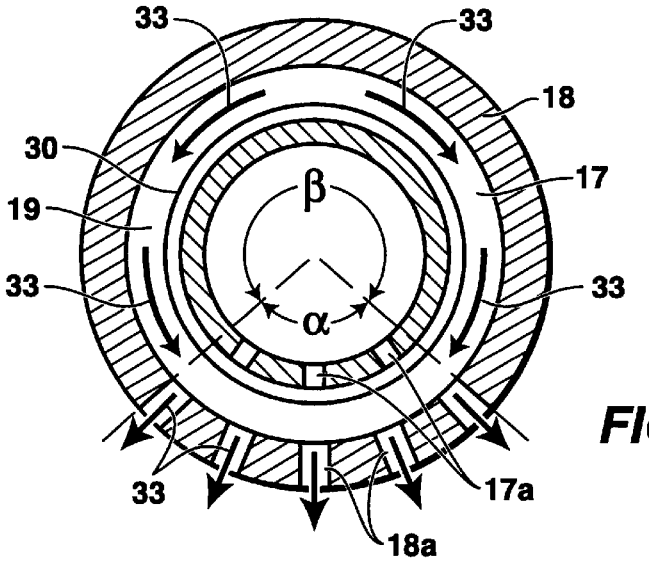
FIG. 3 is a cross-sectional view, taken along line 3—3 of FIG. 2.
Figure 2:
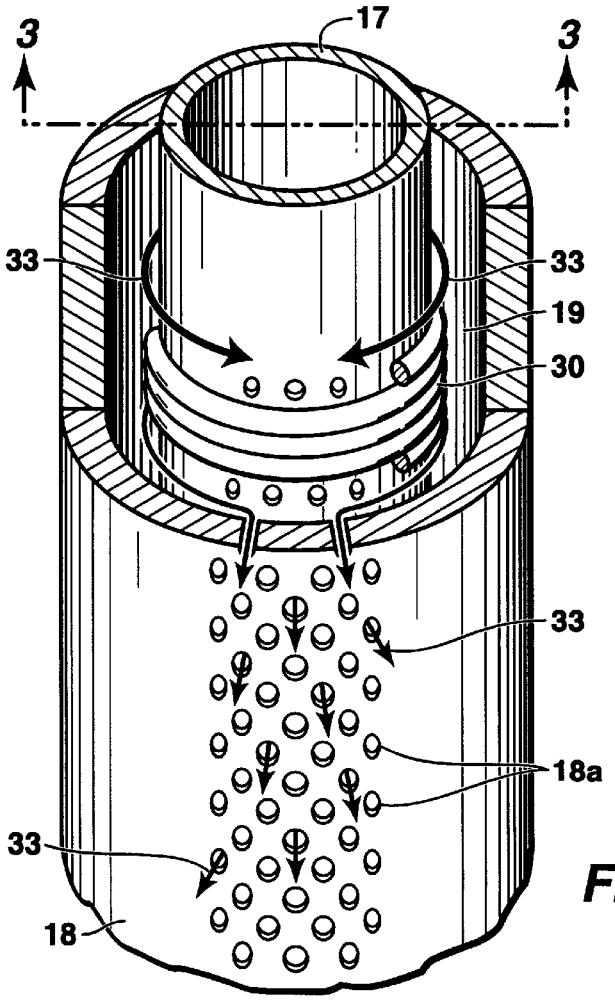
FIG. 2 is a perspective view, partly cut-away, of a portion of the tool of FIG. 1.

Base pipe 17 has a perforated sector (i.e. that sector of the circumference of base pipe 17 which subtends central angle "α", see FIG. 3) and a blank sector (the remaining sector of the circumference of base pipe 17 which subtends central angle "β"), both of these sectors extending substantially along the effective length of base pipe 17. Only the perforated sector has openings (i.e. 17*a*) therein with the blank sector being completely devoid of openings. While central angle "α" may vary widely depending on the particular completion involved, preferably "α" is equal to less than about 180° of the total circumference of base pipe 17. That is, base pipe 17 is perforated about less than 180° of its circumference. However, in some completions where relatively large-diameter pipes (e.g. outer pipe 18 having a 4 inch O.D. or larger) are used, "α" may need to exceed 180°.

In most typical completions, "α" will be significantly less that 180° (e.g. less than about 45°) and in some completions, the perforated sector of base pipe 17 may consist of a single row of openings 17*a* which would be longitudinally-spaced, one above the others along the length of base pipe 17. Again, the remaining blank sector of the circumference of base pipe 17 (subtending angle "β" FIG. 3) is solid along its length and has no perforations or openings therein.

Outer pipe 18 is similar to base pipe 17 in that it also has a perforated sector (i.e. that sector of the circumference of outer pipe 18 which subtends central angle "α", see FIG. 3) and a blank sector (the remaining sector of the circumference of outer pipe 18 which subtends central angle "β"); both of these sectors extending substantially along the effective length of outer pipe 18. Again, only the perforated sector of outer pipe 18 has any openings (i.e. 18*a*) therein with the blank sector being devoid of any openings. Openings 18*a* are large enough to allow the unrestricted flow of both fluids and particulates (e.g. sand) therethrough; hence, slurry can easily flow through the openings 18*a* in outer pipe 18.

As best seen in FIG. 3, when base pipe 17 is assembled within outer pipe 18, the openings 17*a* in base pipe 17 will effectively be radially-aligned with openings 18*a* in outer pipe 18 to thereby provide a "perforated, production sector", through which slurry can exit into the well annulus during the completion operation and through which the produced fluids can flow into screen 10 after the well interval has been completed, this being more fully discussed below. At the same time, the remaining blank sector of outer pipe 18 subtending angle "β" aligns with the blank sector of base pipe 17 to provide a "blank, alternate flowpath" through which the slurry can be delivered to different level within the completion interval.

The upper and lower ends of annulus 19 are effectively open to allow slurry to readily flow into the annulus. Preferably, caps or plates 22 (only top plate shown) or the like, having openings 23 therethrough, are secured to both the inner and outer pipes and act as spacers to thereby maintain the pipes in their spaced, concentric relationship. The openings 23 through top plate 22 which lie over the blank sector provide a direct inlet for a fracturing fluid/gravel slurry into the blank sector of annulus 19 (i.e. "alternate flowpath" of the screen). Also, the upper portions of base pipe 17 and outer pipe 18 can be extended for length 17*b*, 18*b*, respectively, above the upper end of the perforated sector of annulus 19 wherein the entire circumferences of both pipes are unperforated; i.e. annulus 19 is unperforated or blank at its upper end above the perforated sector therein. This allows slurry to freely flow into annulus 19 even if a bridge should quickly form in well annulus 35 adjacent the top of the screened section of tool 10.

In assembling the well tool 10, both the base pipe 17 and the outer pipe 18, respectfully, are perforated to provide openings throughout their respective perforated sectors which subtend the central angle "α" as described above. Again, the size of the central angle "α" will depend on the particular interval to be completed. For example, if large production is expected from a particular interval, a greater sector of the respective pipes will be need to be perforated (hence a greater angle "α") than where lesser production is predicted. Also, to alleviate erosion of these openings during a fracturing/gravel pack operation, a hardened insert (not shown) may be secured in the appropriate openings; see U.S. Pat. No. 5,842,516, issued Dec. 1, 1998, and incorporated herein by reference.

Once openings 17*a* have been provided in the perforated sector of base pipe 17, a continuous length of a wrap wire 30 is wound around its outer surface. Each coil of the wrap wire 30 is slightly spaced from the adjacent coils to form gaps or fluid passageways (not shown) between the respective coils of wire as is commonly done in commercially-available, wire-wrap screens, e.g. BAKERWELD Gravel Pack Screens, Baker Sand Control, Houston, Tex. This allows fluids to readily flow from annulus 19 through the openings 17*a* and into base pipe 17 while effectively blocking the flow of solids (e.g. sand) therethrough. While base pipe 17 has been illustrated as being a wire-wrapped pipe, it should be understood that other known elements used to allow the flow of fluids while blocking the flow of solids can be used as a base pipe, e.g. slotted liners having properly-sized slots, screen material other than wire to cover openings 17*a*, etc.

Outer pipe 18 is positioned over base pipe 17 and the two are held in a spaced relationship by perforated plates 22 (only top plate shown) or the like. At least one inlet 23 is aligned so as to provide an inlet into the blank sector or "alternate flowpath" sector of annulus 19. It will be understood that if more than one length or joint 15 of well screen 10 is used in a particular completion, the outlet from the annulus of an upper joint which will be fluidly-connected to the inlet 23 on an adjacent lower joint so that the alternate flowpath will be continuous throughout the entire length of the well screen 10.

In operation, screen 10 is assembled and lowered into wellbore 11 on workstring 16 until it is positioned adjacent formation 12 and packer 28 is set, as will be understood in the art. Fracturing/gravel slurry (arrows 33) is pumped down the workstring 16 and out ports 32 in "cross-over" 34. The slurry 33 will flow through inlet 23 in plate 22 directly into the blank, alternate flowpath sector "α" of annulus 19. In some instances, the entire flow of slurry 33 may be directed into the top of annulus 19 (e.g. inlet(s) 23) through a manifold 37 or the like. In other completions, the slurry 33 may also be directed simultaneously (a) into the well annulus 35 which surrounds well screen 10, as is typical in prior-art completions of this type.

As the slurry 33 (e.g. a carrier fluid having particulates such as sand suspended therein) flows into the annulus 19, it can not exit from the blank, alternate flowpath sector directly into the well annulus 35 since the outer pipe 18 has no openings in this sector. Accordingly, for the blank sector of annulus 19 to effectively act as an alternate flowpath for the slurry, it is necessary to retard the rate of loss of carrier fluid from the slurry while it is in the blank sector of annulus 19 and as the slurry flows circumferentially from the blank sector into the perforated sector of annulus 19. This is preferably accomplished by using a viscous carrier fluid to form the slurry (i.e. a fluid having a viscosity of not less than about 20 centipoises at a shear rate of 100 reciprocal seconds). Of course, the viscosity of the carrier fluid may be substantially higher (i.e. hundreds or even thousands of centipoises) as needed to retard the rate of fluid loss from the slurry.

As the slurry flows into the perforated sector of annulus 19 either directly from cross-over 34 or circumferentally from the alternate flowpath sector of annulus 19, the slurry will flow out openings 18*a* in outer pipe 18 and into the well annulus 35 where the slurry will fracture the formation 12 and the sand therein will prop the formation and/or be deposited in the well annulus 35 to form a gravel pack around tool 10. Also, as the slurry flows into the perforated sector of annulus 19, the carrier fluid begins to leak-off into the formation or through openings 17*a* in base pipe 17. This causes the perforated sector of annulus 19 to begin to fill with the sand from the slurry. As this occurs, a "sand bridge" will have likely already been formed in well annulus 35.

As the sand pack in the perforated sector begins to build back into the blank sector of annulus 19, the high viscosity of the carrier fluid in the slurry greatly retards further circumferential leak-off through the built-up sand pack within annulus 19. Now, the continued pumping of slurry into the blank sector of the annulus 19 forces the slurry downward to a location where the sand pack has not yet formed within the perforated sector of the annulus 19 thereby effectively extending the length of the completion interval within well annulus 35.

The alternate flowpath sector of annulus 19 is kept open by the slow circumferential growth of the sand pack within annulus 19 and by the relatively high fluid velocity in the remaining open sector of the annulus 19. Thus an alternate flowpath is formed and maintained within annulus 19 by hydraulics which continuously divert the slurry on downstream within annulus 19 much in the same manner as is done mechanically by the perforated, shunt tubes in prior art, alternate-path screens of this type.

It is noted that in some cases, the leak-off of the carrier fluid from the slurry may continue along the blank, alternate flowpath sector of annulus which, in turn, may eventually close or bridge off, thereby blocking any further flow of slurry therethrough. Accordingly, the present invention will likely find greater use in completing relatively shorter intervals (e.g. about 150 feet or less) than those capable of being completed with screens which use shunt tubes to form the alternate paths for the slurry. However, the actual length that can be completed with the present screen may be extended by (a) raising the viscosity of the carrier fluid used in the slurry; (b) decreasing the size and permeability of the sand in the slurry; (c) increasing the pump rate of the slurry; (d) decreasing the width of annulus 19, and etc.

Further, the construction of the perforated sector of base pipe 17 can also have an influence on the length of interval which can be completed with the present invention. That is, if the leak-off of carrier fluid through the openings in base pipe 17 can be limited, the length of the completion interval can be increased. For example, wire wrap 30 is preferably wound directly onto base pipe 17, as herein illustrated, instead of onto spacers which are typically used in prior screens of this type. This prevents carrier fluid within the blank sector of annulus 19 from leaking between the coils of wire and around base pipe 17 to be lost into the perforated sector of the annulus.

Even where the wire 30 is wound directly around the surface of base pipe 17, leak-off of carrier fluid from slurry in the blank sector of annulus 19 can be further retarded by filling the gaps (i.e. flow passages) between the coils of wire 30 which lie in the blank sector with a sealant (e.g. epoxy, tar, etc.) to thereby block any incidental flow of carrier fluid between the coils and around the base pipe into the perforated sector of annulus 19. Still further, the size and number of openings 17*a* in base pipe 17 or the slots in a slotted liner, where such a liner is used as the base pipe, can be limited to the minimum required to handle the expected production of fluids once a well has been completed and has been put on production.

Once the well interval has been completed, the cross-over 34 and workstring 16 are removed and are replaced with a string of production tubing (not shown). The fluids from formation 12 will flow through perforations 14 in casing 13, through the newly-placed gravel pack (not shown), through openings 18*a* in outer pipe 18, between the coils of wire 30, through openings 17*a* and into base pipe 17 to then be produced to the surface through the production tubing. It will be recognized that at this time, annulus 19 between the pipes may also be filled with sand but this will not be a problem since the sand pack within annulus 19 will allow the screen 10 to act much in the same way as a "pre-packed" screen in that the sand in the annulus 19 will allow the produced fluids to readily flow therethrough while at the same time aid in blocking the flow of any unwanted particulates into base pipe 17.

What is claimed is:

1. A well screen comprising:

a base pipe having (a) a perforated sector of its circumference subtending a central angle $\alpha$ and extending along substantially the length of the base pipe, said perforated sector of said base pipe having openings therein and (b) a blank sector of its circumference subtending a central angle $\beta$ and extending substantially the length of said base pipe, said second sector being blank and devoid of openings;

an outer, larger-diameter pipe positioned over said base pipe thereby forming an annulus therebetween, said outer pipe having (a) a perforated sector of its circumference substantially subtending said central angle $\alpha$ and extending substantially the length of said outer pipe, said perforated sector of said outer pipe having openings therein and (b) a blank sector of its circumference substantially subtending said central angle $\beta$ and extending substantially the length of said outer pipe, said blank sector of said outer pipe being blank and devoid of openings; said perforated sector and said blank sector of said outer pipe being radially-aligned with said perforated sector and said blank sector of said base pipe, respectively, when said pipes are assembled to thereby provide a perforated, production sector and an blank, alternate flowpath sector, respectively, within said annulus;

means for allowing flow of fluids through the openings in said perforated sector of said base pipe while blocking flow of solids therethrough; and an inlet at the upper end of said annulus for allowing flow of a slurry containing solids into said annulus wherein said slurry will flow circumferentally from said blank, alternate flowpath sector, into said perforated, production sector of said annulus, and out said openings along the length of said perforated sector of said outer pipe.

2. The well screen of claim 1 wherein said central angle a is less than 180°.

3. The well screen of claim 1 wherein said central angle $\alpha$ is less than 45°.

4. The well screen of claim 1 wherein the width of said annulus is less than about one inch.

5. The well screen of claim 4 wherein the width of said annulus is between about ⅛ inch and about ¼ inch.

6. The well screen of claim 1 wherein said pipes are concentrically-positioned in relation to each other.

7. The well screen of claim 1 wherein said means for allowing flow of fluids through said openings in said base pipe comprises:

a continuous length of wire coiled around the circumference said base pipe wherein each coil of said wire is spaced from the adjacent coils to thereby provide fluid passages between the coils of wire.

8. The well screen of claim 7 including:

means for sealing the portions of said fluid passage between said coils of wire which lie within said blank, alternate flowpath sector of said annulus.

9. The well screen of claim 1 wherein said slurry comprises:

a liquid having a viscosity of not less than about 20 centipoises; and particulates.

* * * * *

UNITED STATES PATENT AND TRADEMARK OFFICE

CERTIFICATE OF CORRECTION

PATENT NO. : 6,220,345 B1 
DATED : April 24, 2001
INVENTOR(S) : Lloyd G. Jones, Raymond J. Tibbles and Gary D. Hurst It is certified that error appears in the above-identified patent and that said Letters Patent is hereby corrected as shown below:

Title page,
Item [73], Assignee add -- Schlumberger Technology Corporation, Sugar Land TX (US) --

Signed and Sealed this

Eleventh Day of June, 2002

*Attest:*

*Attesting Officer*

JAMES E. ROGAN
*Director of the United States Patent and Trademark Office*